United States Patent [19]

Whitman et al.

[11] Patent Number: 4,474,504

[45] Date of Patent: Oct. 2, 1984

[54] UNDERWATER EROSION CONTROL SYSTEM HAVING PRIMARY ELEMENTS INCLUDING TRUNCATED CONICAL RECESSES FOR RECEIVING ARTICULATED INTERCONNECT LINKS

[75] Inventors: Richard F. Whitman; Ronald R. Tankersley, both of Tucson, Ariz.

[73] Assignee: Columbia Building Materials, Inc., Tucson, Ariz.

[21] Appl. No.: 486,928

[22] Filed: Apr. 20, 1983

[51] Int. Cl.[3] ..... E02B 3/12

[52] U.S. Cl. ..... 405/16; 52/582; 404/40; 405/20

[58] Field of Search ..... 405/15, 16, 17, 19, 405/20, 258; 46/26, 31; 52/582, 585, 596, 604; 404/40, 41

[56] References Cited

U.S. PATENT DOCUMENTS

| | | | |
|---|---|---|---|
| 3,522,618 | 8/1970 | Stranzinger | 404/41 X |
| 4,297,816 | 11/1981 | Kella et al. | 52/585 X |
| 4,372,705 | 2/1983 | Atkinson | 405/19 |

FOREIGN PATENT DOCUMENTS

| | | | |
|---|---|---|---|
| 2123523 | 11/1972 | Fed. Rep. of Germany | 405/20 |
| 2161720 | 6/1973 | Fed. Rep. of Germany | 46/31 |
| 958086 | 3/1950 | France | 405/16 |
| 93186 | 2/1922 | Switzerland | 405/16 |

*Primary Examiner*—David H. Corbin

*Attorney, Agent, or Firm*—Cahill, Sutton & Thomas

[57] ABSTRACT

The erosion control system of the present invention typically includes at least first and second primary elements each having at least three sides and a height H. Each primary element includes a truncated conical aperture located in alignment with the midsection of each side and set back into the interior of each primary element. The conical aperture includes a lower diameter $d_1$ and an upper diameter $d_2$ less than $d_1$. A link interconnects the first and second primary elements and includes a height $h<H$. The link includes first and second truncated conical end sections each having a lower diameter $d_3 \leqq d_1$ and an upper diameter $d_4 \leqq d_2$. The conical side surfaces of the end sections are oriented generally parallel to the conical side surfaces of the apertures of the primary elements. A strut is coupled to the first and second end sections of the link to maintain a fixed distance between the end sections.

18 Claims, 14 Drawing Figures

UNDERWATER EROSION CONTROL SYSTEM HAVING PRIMARY ELEMENTS INCLUDING TRUNCATED CONICAL RECESSES FOR RECEIVING ARTICULATED INTERCONNECT LINKS

BACKGROUND OF THE INVENTION

1. Field of the Invention

This invention relates to erosion control systems, and more particularly, to erosion control systems which include primary elements having truncated conical recesses for receiving articulated interconnect links having only first and second ends.

2. Description of the Prior Art

In many environments, it is highly advantageous to protect the surface of an area of soil from erosion due to either wind or water flow. A variety of erosion control systems have been designed primarily for the purpose of preventing soil erosion on the beds and banks of dikes, canals, and rivers or to preserve beaches. Cost, ease of fabrication and installation and overall effectiveness of these erosion control systems each represent significant considerations.

Erco Systems, Inc. of Jefferson, La. has designed and marketed a Tri-lock erosion control system which includes two triangular-shaped interlocking elements. The first triangular-shaped element includes circular end sections for interlocking with cylindrical apertures within a second triangular-shaped element. A plurality of these first and second elements are interlocked to form an erosion control mat. A filter cloth is positioned below this mat and forms a part of the Erco erosion control system. Erco Systems, Inc. also markets another erosion control system including a plurality of blocks of various different configurations which are coupled to a fabric filter cloth for the purpose of preventing soil erosion caused by water flow. Erco Systems markets yet another erosion control system referred to as the TERRAFIX Channel Lining System. This system is fabricated from a plurality of rectangular blocks including horizontally oriented projections on the upper surface. These horizontally oriented projections interlock with corresponding horizontally oriented apertures in the lower surface of adjacent blocks to form a flexible, unitary erosion control system.

Certain types of erosion control systems are also commonly referred to as revetments. Swiss Pat. No. 93,186 (Blanchod) discloses a revetment fabricated from a plurality of substantially rectangular blocks including cylindrical recesses in the end sections of each block. A link having first and second substantially cylindrical end sections fits within the cylindrical recesses in the ends of the adjacent blocks to maintain a fixed distance between adjacent blocks. The Blanchod patent fails to disclose any means for maintaining a fixed distance between adjacent rows of blocks which may be utilized in a revetment.

U.S. Pat. Nos. 2,502,757 (Shearer); 2,454,292 (Pickett); 2,008,866 (Hoffard) and 1,847,852 (Upson) disclose revetment mats which include a plurality of elements typically fabricated from concrete and interconnected by various types of cables or steel links.

U.S. Pat. Nos. 4,152,875; 2,876,628; and 1,983,772 disclose another general type of articulated revetment mat formed from somewhat larger sections of concrete blocks connected by steel links. U.S. Pat. Nos. 3,990,247; 2,159,685; and 1,993,217 disclose revetments formed by placing multiple layers of materials above a bank or river bed.

U.S. Pat. No. 3,903,702 discloses a revetment fabricated from a plurality of interlocking concrete blocks. U.S. Pat. No. 3,922,865 discloses a revetment formed from a plurality of concrete blocks which are secured to an underlying cloth mat.

The following U.S. Patents disclose various other types of erosion control systems: U.S. Pat. Nos. 4,227,829; 4,139,319; 3,597,928; 3,947,190; and 1,179,121.

SUMMARY OF THE INVENTION

It is therefore a primary object of the present invention to provide an erosion control system which is fabricated from a plurality of primary elements loosely coupled together by a plurality of dual-ended interconnecting links to maintain a fixed distance between adjacent primary elements while permitting both vertical and angular relative displacements between adjacent primary elements.

Another object of the present invention is to provide an erosion control system which can readily be mass produced and preassembled on a filter mat to permit rapid installation of the erosion control system at the job site.

Yet another object of the present invention is to provide an erosion control system which can be configured in a variety of different patterns for the purpose of varying either the percentage of area covered by the system or the weight density of the system.

Still another object of the present invention is to provide an erosion control system which can readily either reduce water flow velocity or redirect the path of water flow to achieve desired results.

Still another object of the present invention is to provide an erosion control system which includes gaps between the various elements of the system for receiving soil in which aesthetically pleasing vegetation can be grown.

Still another object of the present invention is to provide an erosion control system which includes articulated interconnecting elements for the purpose of providing uniform contact between the lower surface of the erosion control system and the underlying soil.

Briefly stated, and in accord with one embodiment of the invention, an erosion control system includes first and second primary elements each having at least three sides and a height H. Each side of the primary elements includes a truncated conical aperture having a lower surface diameter $d_1$ and an upper surface diameter $d_2$ less than $d_1$. The truncated conical aperture communicates with the side of the primary element and defines a gap in the aperture. A link interconnects the first and second primary elements and includes a height $h<H$. The interconnecting link includes first and second truncated conical end sections each having a lower diameter $d_3 \leqq d_1$ and an upper diameter $d_4 \leqq d_2$. The conical side surfaces of the end section are oriented parallel to the conical side surfaces of the apertures in the primary elements. A strut is coupled to the first and second end sections of the interconnecting link to maintain a fixed distance between adjacent primary elements.

DESCRIPTION OF THE DRAWINGS

The invention is pointed out with particularity in the appended claims. However, other objects and advantages together with the operation of the invention may be better understood by reference to the following detailed description taken in connection with the following illustrations wherein:

DESCRIPTION OF THE PREFERRED EMBODIMENT

Figure 1:
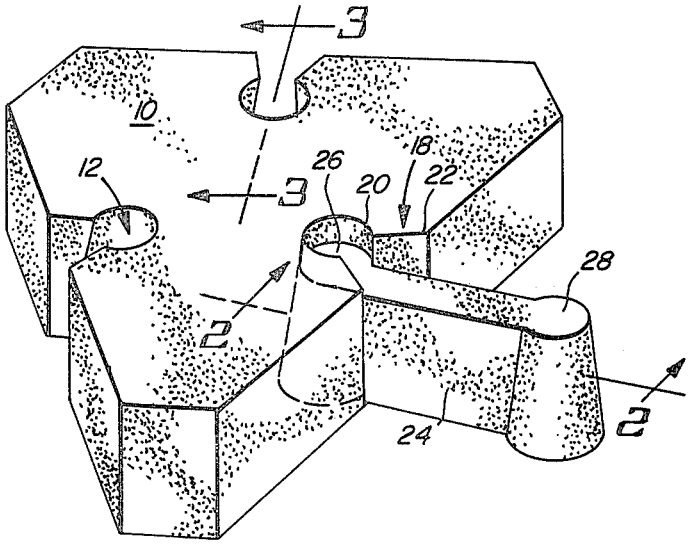
FIG. 1 is a perspective view of the present invention depicting a single primary element interconnected with a single link.
Figure 3:
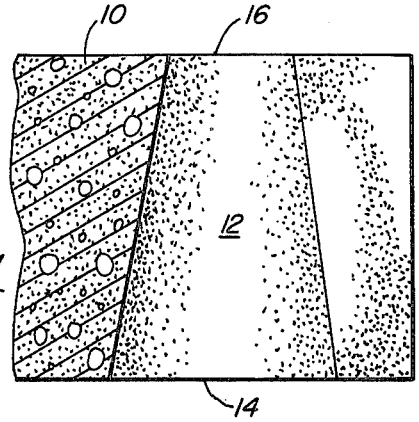
FIG. 3 is a sectional view of the erosion control system primary element depicted in FIG. 1, taken along section line 3—3.

In order to better illustrate the advantages of the invention and its contributions to the art, a preferred hardware embodiment of the invention will now be described in some detail.

Referring now to FIGS. 1-5, the primary element 10 of the erosion control system of the present invention may be formed as an equilateral triangle having truncated tips. In the specific embodiment illustrated in FIG. 1, primary element 10 may be fabricated from concrete aggregate and have the following dimensions: height (H)—6"; side length—14"; truncated tip width—1 1/16".

Each side of primary element 10 includes a truncated conical aperture designated generally by reference number 12 located in alignment with the midsection of each side and set back into the interior of primary element 10. Aperture 12 includes a lower diameter ($d_1$) indicated by reference number 14 and an upper diameter ($d_2$) indicated by reference number 16. Due to the truncated conical configuration of aperture 12, diameter 16 will have a length less than diameter 14. In the preferred embodiment of the invention aperture 12 includes a lower diameter equal to three inches and an upper diameter equal to two inches.

A passageway designated generally by reference number 18 includes a first or inner end 20 which intersects the side of conical aperture 12. Passageway 18 further includes a second or outer end 22 which intersects the side surface of primary element 10.

A link 24 serves the purpose of interconnecting first and second primary elements. Link 24 includes a height (h) which is typically less than the height (H) of primary element 10. In the preferred embodiment of the invention depicted in FIG. 1, line 24 includes a height equal to 4" which is 2" less than the 6 inch height of primary element 10. Link 24 includes a first truncated conical end section 26 and a second truncated conical end section 28. End sections 26 and 28 of link 24 each include a base 30 having a diameter ($d_3$) which is typically somewhat less than the diameter ($d_1$) of the lower surface 14 of truncated conical aperture 12. The first and second end sections of each link 24 further include a top surface 32 having a diameter ($d_4$) equal to or less than the diameter ($d_2$) of the upper surface 16 of truncated conical aperture 12. In the preferred embodiment of the present invention, the base 30 of link 24 includes a diameter of 2 15/16" while the diameter of the top 32 is equal to two inches.

Figure 2:
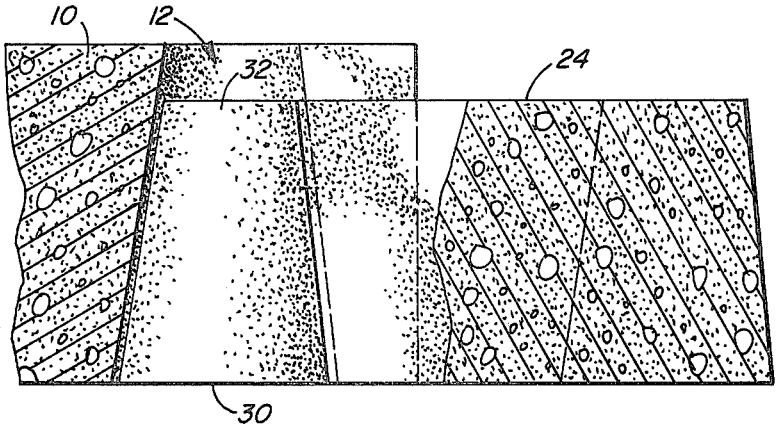
FIG. 2 is a sectional view of the erosion control system elements depicted in FIG. 1, taken along section line 2—2.
Figure 4:
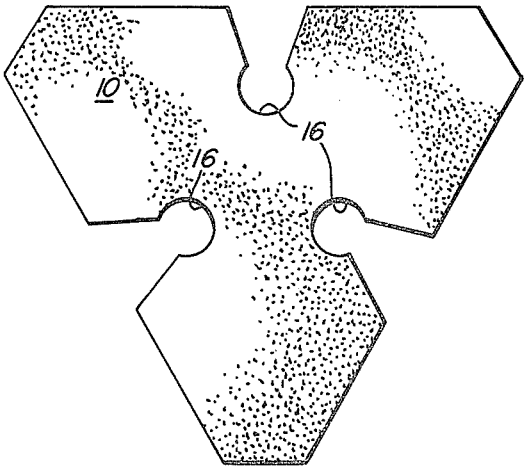
FIG. 4 is a view from above of the primary element of the erosion control system depicted in FIG. 1.
Figure 5:
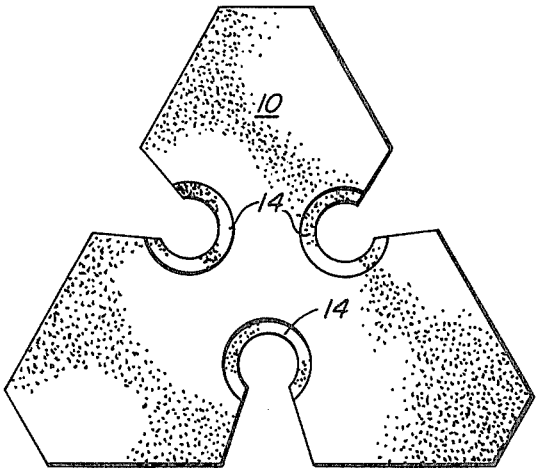
FIG. 5 is a view from below of the primary element of the erosion control system depicted in FIG. 1.

As can be most clearly observed from a review of FIG. 2, an upward vertical displacement of link 32 causes the substantially parallel oriented side surfaces of the first end 26 of link 24 to interface with and lock against the truncated conical inner surface of conical aperture 12. In the preferred embodiment of the present invention described above, the two inch diameter ($d_4$) of the top surface 32 of link 24 is equal to the diameter ($d_2$) 16 of the upper surface of conical aperture 12. Therefore, end 26 of link 24 locks together with primary element 10 when the upper surface of link 24 is approximately even with or below the upper surface of primary element 10.

A strut having a trapezoidal cross section is coupled at each end to the first and second ends 26 and 28 of link 24 for the purpose of maintaining a fixed distance between ends 26 and 28. As a result of the specific configuration of passageway 18, the second end 22 of passageway 18 intersects with the side surface of primary element 10 to form substantially vertically oriented edges. The first end of passageway 18 intersects with the sides of conical aperture 12 to form a substantially trapezoidal surface. Since the width of the upper surface of the top of this trapezoidal surface is slightly greater than the width of the adjacent top section of link 24 and since the width of the base of this trapezoidal surface is somewhat greater than the width of the adjacent section of the trapezoidal strut of link 24, link 24 is free to pivot or articulate both from side to side and to a lesser degree up and down while in the lower or unlocked configuration depicted in FIG. 1. When link 24 is elevated into the upper or locked position, the freedom of link 24 to move or articulate with respect to primary element 10 is substantially eliminated. The presence of an increasingly large relative displacement force between primary element 10 and link 24 will at a certain level produce relative motion between primary element 10 and link 24 which eliminates or substantially reduces the relative forces between these two elements. Once the inclined side surface of the strut of link 24 has been deflected in close proximity to the vertically oriented side surfaces of passageway 18, further relative displacements between primary element 10 and link 24 will be impossible and any further deflection or yielding must take place between primary element 10 and another link 24 which is positioned within one of the other conical apertures of primary element 10.

Figure 6:
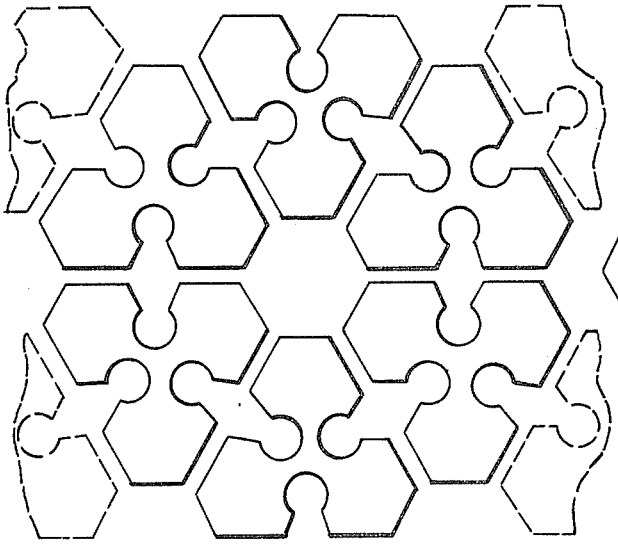
FIG. 6 depicts the manner in which a plurality of primary erosion control elements can be grouped together to form a hexagonal pattern.

Referring now to FIG. 6, a grouping of six primary elements is depicted in a generally hexagonal configuration. This system configuration produces a comparatively large hexagonal aperture at the mid-point of the grouping of six primary elements. In this configuration, a link 24 having a comparatively short length is utilized to secure adjacent primary elements together and to maintain a fixed distance between adjacent primary elements.

Figure 7:
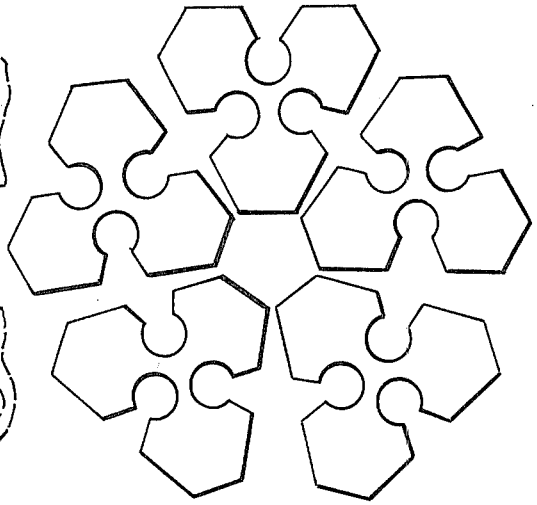
FIG. 7 depicts the manner in which a plurality of primary erosion control elements can be grouped together to form a pentagonal pattern.
Figure 8:
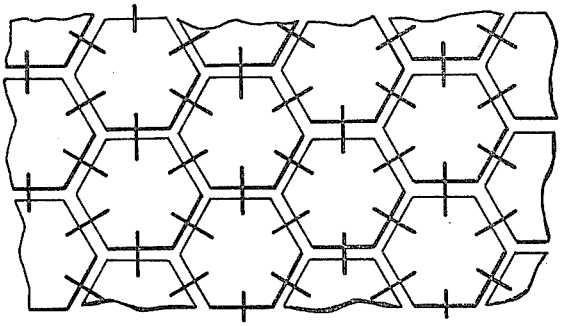
FIG. 8 depicts the manner in which a pattern of hexagonal shaped primary erosion control elements can be coupled together.
Figure 9:
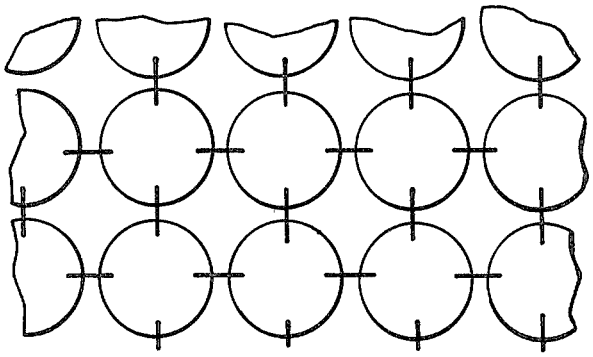
FIG. 9 depicts the manner in which a pattern of circular primary erosion control elements can be grouped together.
Figure 10:
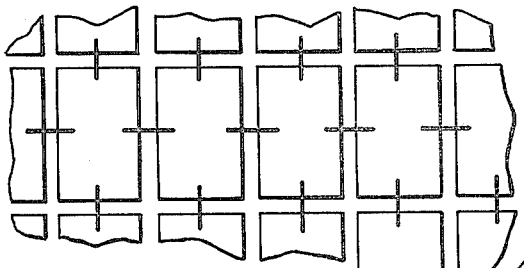
FIG. 10 depicts the manner in which a group of rectangular primary erosion control system elements can be grouped together.

FIG. 7 depicts yet another possible configuration of the primary elements of the erosion control system of the present invention. In this system configuration, a longer length link may be utilized than was the case in the hexagonal grouping depicted in FIG. 6. The length of the link utilized in any particular configuration assists in determining the possible pattern or configuration of primary elements as well as the percentage of the underlying soil or surface which will be covered by the erosion control system. For certain applications, it may be desirable to utilize a comparatively low density coverage of primary elements over the underlying surface to be protected. To achieve this lower density configuration, the link length may be increased or the particular configuration of the primary element may be modified. In the erosion control system configuration depicted in FIG. 8, a hexagonal primary element is utilized to produce a comparatively high density coverage of an underlying surface. In the configuration depicted in FIG. 9, a plurality of circular primary elements is utilized to achieve a comparatively low density coverage of the underlying surface. FIG. 10 indicates yet another configuration of the erosion control system of the present invention in which a plurality of rectangular primary elements is coupled together by a series of links. The length of the links utilized in the FIG. 10 embodiment determines both the weight and area density of coverage of the erosion control system.

Figure 11:
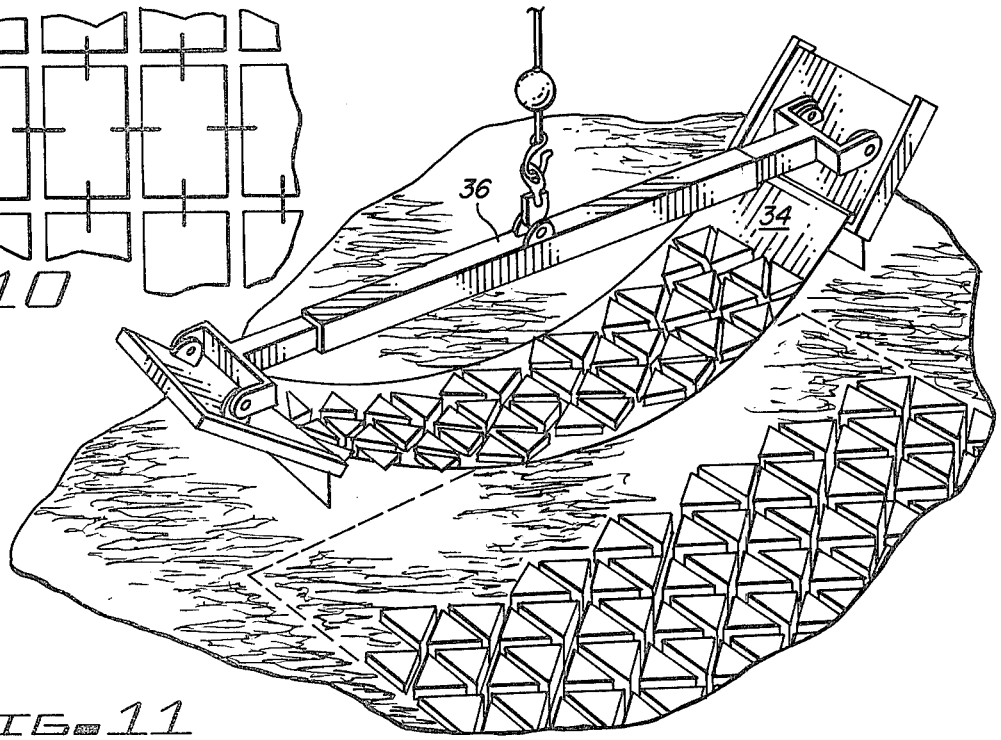
FIG. 11 depicts the manner in which a plurality of preassembled erosion control system elements can be supported by a single length of filter cloth and installed as a unit on a surface.

Referring now to FIG. 11, a plurality of primary elements configured as equilateral triangles have been preassembled with links on the upper surface of a filter cloth 34 to form a prefabricated erosion control system mat or mattress. The ends of this pre-fabricated mat can be clamped to an adjustable handling bar 36 as depicted to permit a crane or other lifting device to remove the prefabricated mat from a truck and to install the mat at the selected site. The concrete elements of the erosion control system are typically positioned within the inner boundary of the filter cloth to provide an exposed section of filter cloth along one side. An adjacent prefabricated mat is positioned over this excess width of filter cloth to form an overlapping boundary between the two adjacent units for the purpose of locking adjacent filter cloth units together.

Filter cloth of an appropriate porosity and strength is commercially available from the Phillips Petroleum Company. Sheets of filter cloth are typically fabricated with an eight foot width and a twenty foot length. The filter cloth forms a mechanically strong yet mechanically permeable membrane for handling the erosion control system of the present invention and for adding mechanical strength to the elements of the system. The filter cloth not only protects the underlying soil or other surface but also assists in distributing the weight of the erosion control system elements and the external forces applied to the elements of the erosion control system.

Since the erosion control system of the present invention covers significantly less than one hundred percent of the underlying soil surface and due to the substantial porosity of the filter cloth, the erosion control system serves to substantially equalize hydrostatic pressure on both the upper and lower surface of the system. In addition, the inherent permeability of the system to water permits water to percolate downward through the erosion control system to the ground water supply.

In many applications, it is desirable to fill in the gaps or space between the various elements of the erosion control system to either further strengthen the system or to promote the growth of vegetation for aesthetic purposes. As a result of the unique combination of the primary elements and dual ended interconnecting link, both relative vertical and rotational displacements between adjacent primary elements can be accommodated without damaging either the primary element or the interconnecting link. This inherent system flexibility prevents damage to the system caused by upward displacements from sources such as roots, downward displacements caused by soil compaction or various other irregular and unpredictable vertical or rotational displacements.

The overall weight density of the erosion control system of the present invention can be readily changed as required. In order to modify the overall weight density of the system, the thickness of the primary elements and interconnecting links together with the specific gravity of the concrete aggregate material utilized to fabricate the elements of the system can be altered as required. In addition, the configuration of the primary elements can readily be modified to cover either an increased or decreased percentage of the underlying soil surface.

Figure 12:
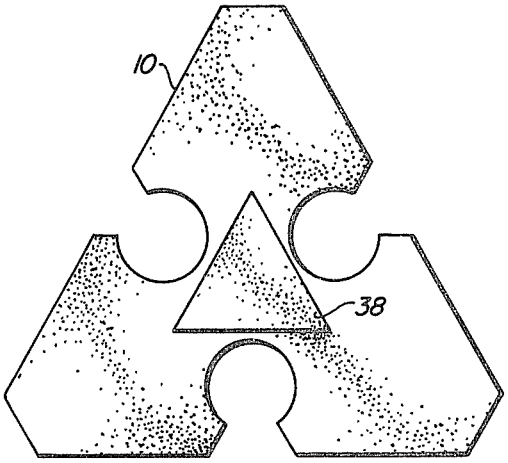
FIG. 12 illustrates a primary erosion control element having a triangular-projection coupled to the upper surface thereof.
Figure 13:
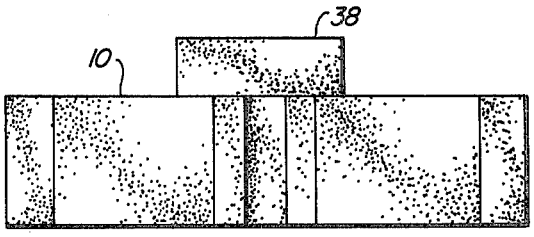
FIG. 13 depicts an elevational view of the primary erosion control system element depicted in FIG. 12.

Referring now to FIGS. 12 and 13, yet another embodiment of the erosion control system of the present invention is depicted which includes a triangular-shaped upward projection 38 from the upper surface of primary element 10. When this configuration of primary element 10 is positioned below the surface of a flow of water, a significant amount of drag and turbulence is imparted to the water which serves to reduce the water flow velocity. In alternative embodiments, projection 38 may be configured as a rectangular projection or vane for the purpose of redirecting the water flow as well as reducing the water flow velocity.

Figure 14:
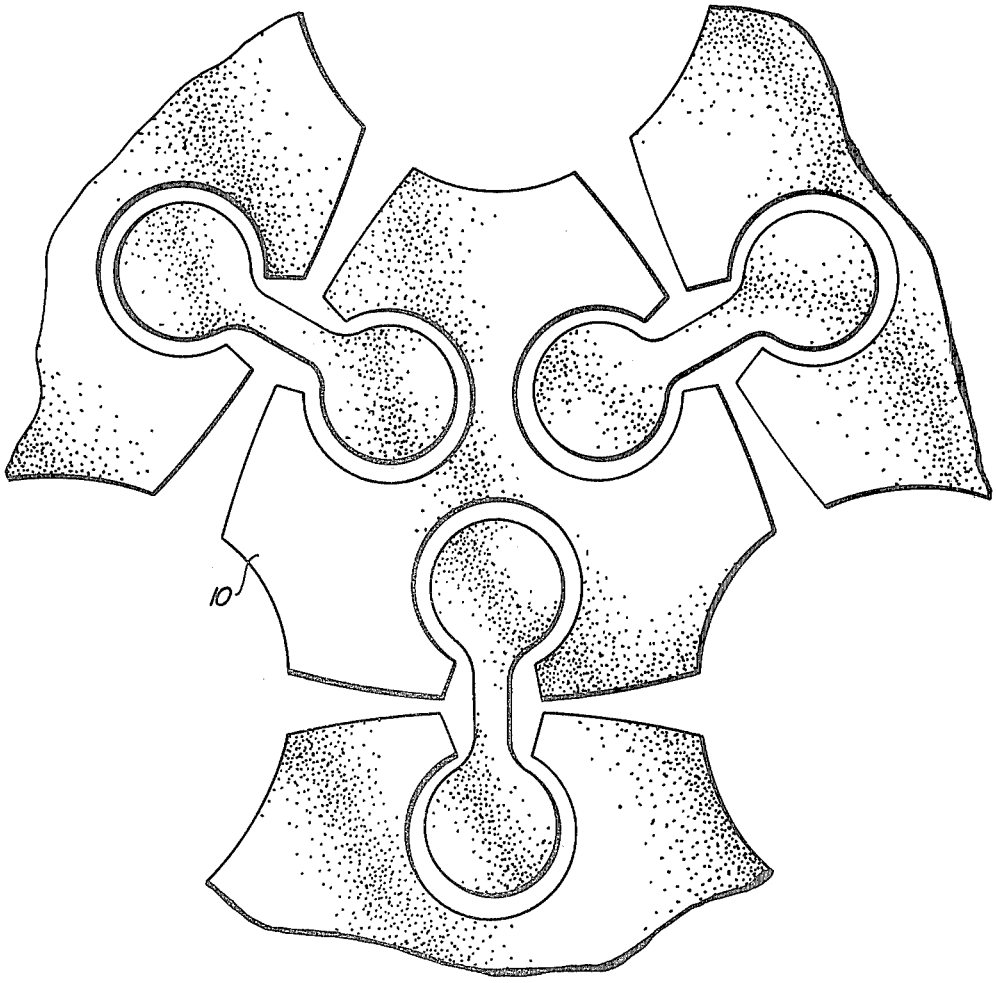
FIG. 14 depicts yet another embodiment of the erosion control system of the present invention.

FIG. 14 illustrates yet another configuration for primary element 10 which produces yet another pattern of the erosion control system.

The underlying soil surface should typically be graded into the desired configuration before either manual installation or prefabricated mats of the erosion control system are installed. To increase the overall effectiveness of the erosion control system when the system is to be applied to a surface which extends both above and below the water level, the upper end of the system should typically extend well above the high water mark while the lower end of the system should extend down an embankment area to a level below the scour line caused by the water flow path.

It will be apparent to those skilled in the art that the disclosed erosion control system may be modified in numerous ways and may assume many embodiments other than the preferred forms specifically set out and described above. For example, the overall size, color, depth and geometric configuration of the primary elements can be readily altered yet still be secured together by the dual ended interconnecting link disclosed above. Accordingly, it is intended by the appended claims to cover all such modifications to the invention which fall within the true spirit and scope of the invention.

We claim:

1. An erosion control system comprising:

a. first and second primary elements each having at least three sides and a height H, each side of said primary element including a truncated conical aperture having a lower surface diameter $d_1$ and an upper surface diameter $d_2$ smaller than $d_1$, said aperture communicating with the side of said primary element and defining a gap in said aperture; and b. a link for interconnecting said first and second primary elements having a height $h \leqq H$ and including i. first and second truncated conical end sections each having a lower diameter $d_3 \leqq d_1$ and an upper diameter $d_4 \leqq d_2$, the conical side surfaces of said end sections being parallel to the conical side surfaces of the apertures in said primary elements; and ii. a strut coupled to said first and second end sections for maintaining a fixed distance between said end sections.

2. The erosion control system of claim 1 wherein said primary elements are equal in size.

3. The erosion control system of claim 1 wherein said truncated conical apertures are positioned in alignment with the midsection of each side of said primary elements.

4. The erosion control system of claim 1 wherein $h<H$, $d_3<d_1$, and $d_4<d_2$.

5. The erosion control system of claim 1 wherein said first and second primary elements and said link are fabricated from concrete.

6. The erosion control system of claim 1 further including a filter fabric mat positioned in contact with the lower surfaces of said first and second primary elements.

7. The erosion control system of claim 4 wherein the width of the base of said gap exceeds the width of the top of said gap.

8. The erosion control system of claim 1 wherein the width of the gap in said aperture determines the angular range through which said link can be articulated with respect to said primary elements.

9. An erosion control system comprising:

a. first and second primary elements each having at least three sides and a height H and including:

i. a truncated conical aperture located in alignment with the midsection of each side and set back into the interior of said primary element, said aperture having a lower diameter $d_1$ and an upper diameter $d_2$ smaller than $d_1$;

ii. a passageway having a first end intersecting said conical aperture and a second end intersecting the side of said primary element; and b. a link for interconnecting said first and second primary elements having a height $h \leqq H$ and including i. first and second truncated conical end sections having a lower diameter $d_3 \leqq d_1$ and an upper diameter $d_4 \leqq d_2$, the conical side surfaces of said end sections being parallel to the conical side surfaces of the apertures in said primary elements; and ii. a strut coupled to said first and second end sections for maintaining a fixed distance between said end sections.

10. The erosion control system of claim 9 wherein said primary elements are configured as equilateral triangles.

11. The erosion control system of claim 10 wherein $h<H$, $d_3<d_1$ and $d_4=d_2$.

12. The erosion control system of claim 11 wherein the average width of the first end of said passageway is less than the average width of the second end of said passageway for permitting relative articulating motion between said link and said primary elements.

13. The erosion control system of claim 12 wherein the width of the first end of said passageway is less than $d_4$.

14. The erosion control system of claim 13 wherein said strut includes a trapezoidal cross section.

15. The erosion control system of claim 14 wherein the width of the upper horizontal surface of said trapezoidal strut is less than $d_4$ and wherein the width of the lower horizontal surface of said trapezoidal strut is less than $d_3$.

16. The erosion control system of claim 11 wherein said strut is bilaterally symmetric.

17. The erosion control system of claim 9 wherein said first and second primary elements and said strut are fabricated from concrete.

18. The erosion control system of claim 11 wherein said strut is locked together with said first and second primary elements when said strut is elevated such that the outer surface of said conical end sections engages and locks together with the inner conical surface of said apertures in said first and second blocks.

* * * * *